US010513828B2

(12) United States Patent
Schmid et al.

(10) Patent No.: US 10,513,828 B2
(45) Date of Patent: Dec. 24, 2019

(54) COMPOSITION FOR SIZING PAPER

(71) Applicant: Kemira Chemie Ges.mbH, Krems Donau (AT)

(72) Inventors: Leo Schmid, Krems (AT); Jürgen Sartori, Stratzing (AT)

(73) Assignee: Kemira Chemie Ges.mbH, Krems Donau (AT)

( * ) Notice: Subject to any disclaimer, the term of this patent is extended or adjusted under 35 U.S.C. 154(b) by 0 days.

(21) Appl. No.: 15/638,823

(22) Filed: Jun. 30, 2017

(65) Prior Publication Data

US 2017/0306565 A1 Oct. 26, 2017

Related U.S. Application Data

(62) Division of application No. 13/129,241, filed as application No. PCT/AT2009/000435 on Nov. 13, 2009, now abandoned.

(30) Foreign Application Priority Data

Nov. 14, 2008 (AU) ..... 17722008

(51) Int. Cl.

| | |
|---|---|
| ***D21H 21/16*** | (2006.01) |
| ***D21H 17/15*** | (2006.01) |
| ***D21H 17/28*** | (2006.01) |
| ***D21H 17/36*** | (2006.01) |
| ***D21H 17/16*** | (2006.01) |
| ***D21H 17/18*** | (2006.01) |
| ***D21H 17/70*** | (2006.01) |
| ***D21H 21/24*** | (2006.01) |

(52) U.S. Cl.

CPC ..... *D21H 21/16* (2013.01); *D21H 17/15* (2013.01); *D21H 17/16* (2013.01); *D21H 17/18* (2013.01); *D21H 17/28* (2013.01); *D21H 17/36* (2013.01); *D21H 17/70* (2013.01); *D21H 21/24* (2013.01)

(58) Field of Classification Search

CPC ..... D21H 17/16; D21H 17/18; D21H 17/28; D21H 17/36; D21H 17/70; D21H 21/16; D21H 21/24

See application file for complete search history.

(56) References Cited

U.S. PATENT DOCUMENTS

| | | | | |
|---|---|---|---|---|
| 4,356,238 | A * | 10/1982 | Lakshmanan | B32B 27/04 428/343 |
| 4,529,447 | A | 7/1985 | Okada et al. | |
| 4,849,131 | A * | 7/1989 | Sweeney | B01F 17/0028 516/74 |
| 2002/0123560 | A1* | 9/2002 | Audenaert | C03C 25/26 524/588 |
| 2004/0055677 | A1* | 3/2004 | Filippini | B01F 17/0021 149/46 |
| 2008/0227913 | A1* | 9/2008 | Koide | C08K 3/22 525/54.3 |
| 2008/0277084 | A1 | 11/2008 | Denowski et al. | |

FOREIGN PATENT DOCUMENTS

| | | | | |
|---|---|---|---|---|
| AT | A1772-2008 | | 11/2009 | |
| JP | 2006-022427 | * | 1/2006 | D21H 21/16 |
| WO | 02-33172 | A1 | 4/2002 | |
| WO | 2006096216 | A1 | 9/2006 | |
| WO | 2007070912 | A1 | 6/2007 | |
| WO | 2007073321 | A1 | 6/2007 | |
| WO | 2010054419 | A1 | 5/2010 | |

OTHER PUBLICATIONS

English translation of Kawatani (DE3300438A1), pulication date Jul. 21, 1983.*

International Search Report for International Application No. PCT/AT2009/000435; dated Apr. 29, 2010; 4 pages.

Written Opinion of the International Searching Authority for International Application No. PCT/AT2009/000435, filed Nov. 13, 2009; dated Apr. 29, 2010; 3 pages.

* cited by examiner

*Primary Examiner* — Jun Li

(74) *Attorney, Agent, or Firm* — Thomas|Horstemeyer, LLP

(57) ABSTRACT

A composition for sizing paper includes alkenylsuccinic anhydride (ASA) as the sizing agent and an emulsifier system of anionic emulsifiers and nonionic components, wherein the anionic emulsifiers are chosen from alkali metal salts of aliphatic carboxylic acids or aliphatic dicarboxylic acids and the nonionic components are chosen from polyethylene glycols.

14 Claims, No Drawings

COMPOSITION FOR SIZING PAPER

CROSS REFERENCE TO RELATED APPLICATION

This application is a divisional of and claims priority to co-pending application Ser. No. 13/129,241, filed Aug. 15, 2011, entitled "Composition for Sizing Paper", which is a U.S. national stage of Application No. PCT/AT2009/000435; filed on Nov. 13, 2009; and assigned International Publication No. W02010 054419A1; published on May 20, 2010, which are entirely incorporated herein by reference. Priority under 35 U.S.C. § 119(a) and 35 U.S.C. § 365(b) is claimed from Austrian Patent Application No. AT A1772 2008; filed Nov. 14, 2008, the disclosure of which is also incorporated herein by reference.

The invention relates to a composition for sizing paper, which comprises alkenylsuccinic anhydride (ASA) as a sizing agent and an emulsifier system of anionic emulsifiers and nonionic components, and to a process for the preparation thereof In paper production, a change in paper sizing agents from the traditional rosin sizing agents to synthetic sizes, such as alkyl ketene dimer (called AKD in the following) and alkenylsuccinic anhydride (also called ASA in the following) has taken place in the past. By using these novel cellulose-reactive sizing agents, inter alia the consumption of sizing agent can be reduced drastically, for example by a factor of from 10 to 20. The associated commercial advantages led to a far-reaching change-over to these sizing agents, and AKD and ASA are currently among the widely used cellulose-reactive sizing agents.

In contrast to AKD, ASA is transported from the producer to the customer not as an aqueous emulsion, but as the pure substance. For sizing, ASA must be employed in the form of an aqueous emulsion. However, since ASA is sensitive to hydrolysis, the emulsion must be formed directly on site at the papermaking machine, which requires installation of an emulsifying unit and is associated with additional costs.

There is therefore a need for a system which ensures satisfactory performance of the sizing agent with respect to particle size and sizing efficiency, with minimal costs for the emulsifying unit. Such an emulsifying unit is one which operates with reduced shearing forces. In order nevertheless to achieve the aim of an ASA emulsion with a high sizing efficiency and emulsion stability, the sizing agent ASA must be modified chemically, or emulsifiers must be added to it.

Sizing agents based on ASA with addition of emulsifiers are known from the prior art. Thus, WO 2006/096216 describes a process for sizing a paper product, which envisages as a second step the formation of an aqueous sizing emulsion containing an alkenylsuccinic anhydride component in the absence of high shearing forces, the emulsion being obtained in the presence of a cationic component. The alkenylsuccinic anhydride component contains alkenylsuccinic anhydride suspended in an aqueous polymer solution, it being possible for the polymers to be chosen, inter alia, from anionic and nonionic polymers. Although this sizing agent containing ASA can be emulsified employing reduced shearing forces, it has a low sizing efficiency and the disadvantage that it is not possible to produce a stable emulsion under high shearing forces.

A further sizing agent of this type is described in WO 2007/073321. This is an aqueous dispersion of a cellulose-reactive sizing agent, such as ASA, and an anionic polyelectrolyte and a nitrogen-containing organic compound, which is an amine or a quaternary ammonium having a molecular weight below 180 and/or one or more hydroxyl groups. However, such sizing agents have the disadvantage that they cannot be emulsified with hot starch, such as is provided on any papermaking machine. The requirement of continuous cooling of starch, however, is associated with additional difficulties in the process procedure and the design of the installation, and leads inter alia to an increase in the costs of the installation.

Further emulsifier systems for use with cellulose-reactive sizing agents are to be found in WO 02/33172. This describes an aqueous composition which comprises a cellulose-reactive sizing agent, which can be an alkenylsuccinic anhydride, with a system of dispersing agents of a first anionic dispersing agent and a second dispersing agent, which second dispersing agent is chosen from cationic or nonionic dispersing agents, and at least one inorganic metal salt. By employing this dispersing agent system, a simultaneous use of ASA and alum, the latter being employed for dewatering of paper webs, is said to be made possible. Polyethylene oxides are mentioned as examples of nonionic dispersing agents. The examples show exclusively paper sizing emulsions comprising alkyl ketene dimer (AKD) with anionic and cationic dispersing agents, although it is said to be possible also to use alkenylsuccinic anhydride in the aqueous compositions. The problems of using low shearing forces/high shearing forces during emulsification on site are not of significance in this patent application and do not present themselves for the paper sizing agents based on AKD which are illustrated exclusively therein by way of example: AKD is a wax which is solid at room temperature and is transported to the customer already as an emulsion.

Finally, the US application No. 2008/0277084 claims among others an ASA blend comprising ASA and at least one anionic surfactant and at least one nonionic surfactant. As such blends ASA blends comprising as anionic surfactant sulfosuccinate esters and as nonionic surfactant a polyoxyalkylene compound, such as a polyoxyalkylene alkyl ether are disclosed. This combination is said to have an effect on the average particle size in the emulsion resulting in a smaller particle size than the single surfactants, thus low-shear equipment may be used.

The abovementioned aim of an ASA emulsion which can be employed as a paper sizing agent with a high sizing efficiency and emulsion stability is achieved by a composition of the abovementioned type, which contains an emulsifier system wherein the anionic emulsifiers are chosen from alkali metal salts of aliphatic carboxylic acids or aliphatic dicarboxylic acids and the nonionic components are chosen from polyethylene glycols (hereinafter also referred to as PEG). Alkenylsuccinic anhydride having an alkenyl chain length of from 12 to 24 C atoms, preferably from 16 to 18 C atoms, is particularly suitable as the sizing agent.

The anionic emulsifier is preferably a sodium or potassium salt of an alkenylsuccinic acid having an alkenyl chain length of from 12 to 24 C atoms, preferably from 16 to 18 C atoms.

A further advantage of the composition according to the invention is also to be seen in that the anionic emulsifier can be formed in situ by addition of an alkali metal hydroxide to the cellulose-reactive sizing agent. The chemical structure of the anionic emulsifier is then very similar to that of the sizing agent.

The nonionic component is preferably polyethylene glycol having an average molecular weight of from 200 to 8,000, preferably of 2,000.

To achieve the advantages according to the invention, the composition according to the invention comprises the emulsifier system in an amount of up to 5 wt. %, based on the alkylsuccinic anhydride (ASA), preferably of from 0.3 wt. % to 1.5 wt. %. In this context, the ratio of anionic emulsifiers to nonionic component, based on the weight, is preferably from 1:10 to 10:1. Here and in the remainder of the description, the wording "anionic emulsifiers" and "nonionic components" includes both a single emulsifier/a single component and mixtures of several anionic emulsifiers or nonionic components.

The compositions according to the invention for sizing paper can be prepared by mixing the corresponding components in any desired sequence. The compositions are advantageously prepared by addition of an alkali metal hydroxide to the alkenylsuccinic anhydride (ASA), as a result of which the anionic emulsifiers are formed in situ, and subsequent dissolving of the nonionic component polyethylene glycol therein, preferably at an elevated temperature of from about 100 to 140° C. Alternatively, the nonionic component can also be added before the in situ formation of the anionic emulsifier by saponification. It is thus also possible to provide the composition for sizing paper in the form of a concentrate which contains, for example, alkenylsuccinic anhydride and 14 to 18 wt. %, more practically about 16 wt. %, of the emulsifier system. If required, this concentrate can be diluted to the conventional concentration of the composition according to the invention by stirring into emulsifier-free ASA without the use of elevated temperatures.

For use in the sizing of paper, the mixture obtained in this way is emulsified with an aqueous phase optionally containing starch using low shearing forces, in order to give the sizing emulsion.

Low shearing forces in the context of the invention can be generated by static mixing, apertures, nozzles, peristaltic or centrifugal pumps or rotor-stator systems with a low to moderate speed of rotation. The energy introduced here by the emulsifier system is low. High shearing forces are achieved with special shearing tools, such as rotor-stator systems with high speeds or high pressure emulsifier systems (>100 bar). The energy introduced into the emulsion in this context is high.

The advantages of the composition according to the invention are explained in more detail below with the aid of examples.

EXAMPLE 1

This example shows the sizing efficiency as a function of the emulsifiers or emulsifier systems employed.

Since the relevant parameter in sizing of paper is the sizing efficiency or the hydrophobizing action, the sizing was in each case checked with the aid of laboratory sheets after a change in the emulsifier/emulsifier system. For this, the Cobb 60 value (called Cobb 60 in the following), which describes the water uptake in g/m$^2$ in 60 seconds, was used.

To test the ASA emulsifier mixtures, a laboratory sheet-forming unit, the Rapid-Kothen system, was used. The pulp used was a bleached sulphate pulp with a 70% long fibre and 30% short fibre content, ground to a Schopper-Riegler freeness of 30°.

Emulsifying process with high shearing forces:

In order to be able to evaluate the efficiency of an emulsifier system, an emulsifier-free ASA (AS 1000) as a standard was emulsified as the sizing agent in the conventional manner, i.e. using very high shearing forces. 1 part of liquid sizing agent was added to 99 parts of a 4% strength cationic starch solution (Hicat 5103 A) and the mixture was then emulsified for one minute with a shearing apparatus (Ultraturrax) at 10,000 revolutions per minute. This emulsion was diluted 1:10 with water and an aliquot of this dilution was employed for sizing a laboratory sheet.

A modified emulsifying process with which it is not possible to prepare an emulsion which achieves a satisfactory sizing efficiency if an emulsifier-free sizing agent is used was now contrasted with this emulsifying process.

Emulsifying process with low shearing forces:

This emulsifying process comprises emulsification of 5 parts of the sizing agent with 95 parts of water for one minutes with a shearing apparatus (Ultraturrax) at only 4,000 revolutions per minute. 20 g of the pre-emulsion obtained in this way are now stirred into 80 g of 5% strength cationic starch solution. This emulsion is now diluted 1:10 with water and an aliquot of this dilution is employed for sizing a laboratory sheet.

Various anionic or nonionic emulsifiers/components and mixtures thereof were now added to the ASA, laboratory sheets were formed and sizing tests were carried out. The results can be seen from the following tables:

TABLE 1a

Sizing values after addition of anionic emulsifiers. The sizing values are stated in Cobb 60 [g of water uptake/m$^2$].

| | Cobb 60 [g/m$^2$] | | Amount |
|---|---|---|---|
| | High shearing forces | Low shearing forces | of size [kg/t of paper] |
| No emulsifier (comparison) | 22 | 85 | 1.0 |
| 1% Dioctyl sulphosuccinate | — | 90 | 1.0 |
| 0.1% Na-ASA | — | 95 | 1.0 |
| 1% Na-ASA | — | 92 | 1.0 |
| 0.3% Na-ASA | — | 88 | 1.0 |
| 1% K-ASA | — | 95 | 1.0 |
| 0.3% heptadecanoic acid K salt | — | 92 | 1.0 |

In the above Table as well as in the following description Na-ASA means alkylsuccinic acid sodium salt and K-ASA means alkylsuccinic acid potassium salt.

The table shows that when using the anionic emulsifiers employed, no improvement in sizing occurs when low shearing forces are applied.

TABLE 1b

Sizing values after addition of nonionic component. The sizing values are stated in Cobb 60 [g of water uptake/m$^2$].

| | Cobb 60 [g/m$^2$] | | Amount of size |
|---|---|---|---|
| | High shearing forces | Low shearing forces | [kg/t of paper] |
| No emulsifier | 22 | 85 | 1.0 |
| 0.5% PEG 2000 | — | 72 | 1.0 |
| 1% PEG 2000 | — | 52 | 1.0 |
| 1.5% PEG 2000 | — | 55 | 1.0 |

The table shows that when using the nonionic component PEG 2000 an improvement in sizing occurs when low shearing forces are applied.

TABLE 1c

Sizing values after addition of various nonionic emulsifiers/components in combination with 0.3 wt. % of Na-ASA (alkylsuccinic acid sodium salt) as an anionic emulsifier. The sizing values are stated in Cobb 60 [g of water uptake/m$^2$].

| | Cobb 60 [g/m$^2$] Low shearing forces | Amount of size [kg/t of paper] |
|---|---|---|
| 0.5% PEG 2000 | 30 | 1 |
| 1% PEG 2000 | 25 | 1 |
| 0.5% Empilan KCL 5 | 77 | 1 |
| 0.5% Empilan KCL 5 | 71 | 1 |
| 0.5% Walloxen ID 30 | 83 | 1 |
| 0.5% Walloxen LM 100 | 52 | 1 |
| 0.5% Walloxen SH 20 PF | 94 | 1 |
| 0.5% Walloxen SH 30 70 PF | 66 | 1 |
| 0.5% Walloxen SH 55 95 PF | 82 | 1 |

Empilan and Walloxen are trademarks for nonionic emulsifiers based on fatty alcohol ethoxylate or fatty acid ethoxylate.

The table shows that by the combination according to the invention of the specific anionic emulsifiers with polyethylene glycol as a nonionic component an improvement in the sizing efficiency is achieved. This improvement furthermore exceeds that which was to be expected for this specific combination on the basis of the results when the particular emulsifiers/components are used by themselves (Table 1a and 1b). It can furthermore be seen from Table 1c that this synergistic effect does not occur in combinations of the specific anionic emulsifiers with other nonionic emulsifiers, such as are illustrated by Empilan and Walloxen.

EXAMPLE 2

In this example the sizing efficiency of various combinations of anionic emulsifiers and nonionic components was investigated. In this context, the materials and preparation processes employed in Example 2 and the test methods described therein were used. The emulsification in each case took place using low shearing forces.

TABLE 2

Sizing values after addition of various polyethylene glycols in combination with anionic Na-ASA. The sizing values are stated in Cobb 60 [g of water uptake/m$^2$].

| PEG 200 [%] | PEG 2000 [%] | PEG 4000 [%] | Na-ASA [%] | Cobb 60 [g/m$^2$] |
|---|---|---|---|---|
| 0.5 | — | — | 0 | 84 |
| 1 | — | — | 0 | 92 |
| 1 | — | — | 0.3 | 79 |
| — | 1 | — | 0.3 | 25 |
| — | 1 | — | 1 | 25 |
| — | — | 0.5 | 0.3 | 36 |
| — | — | 0.5 | 0.7 | 53 |
| — | — | 1 | 0.3 | 57 |
| — | — | 1 | 1 | 44 |

The experiments show that combinations of Na-ASA and polyethylene glycols show an improved sizing efficiency compared with the use of polyethylene glycols by themselves. The most significant improvement was achieved in this context with a combination of Na-ASA (0.3%) with PEG 2000 (1%)

EXAMPLE 3

An ASA composition according to the invention (comprising ASA and a combination of Na-ASA (0.3%) with PEG 2000 (1%)) or AS 1000 (a conventional emulsifier-free ASA) and a 4% strength starch solution (Hicat 5103 A) were sucked in over a laboratory water-jet pump and emulsified via the water jet. The particular flow ratios of ASA, starch and water were chosen such that a 1% strength ASA emulsion was obtained. Finally, this was employed for sizing laboratory sheets.

TABLE 3

| | Amount of size [kg/t of paper] | Cobb 60 [g/m$^2$] |
|---|---|---|
| AS 1000 | 0.35 | 76 |
| | 0.5 | 52 |
| | 0.75 | 32 |
| | 1 | 23 |
| ASA composition according to the invention | 0.25 | 74 |
| | 0.5 | 33 |
| | 0.75 | 27 |
| | 1 | 26 |

The table shows that with the exception of the amount of size of 1 kg/t (oversizing), lower Cobb 60 values and therefore an improved sizing efficiency can be achieved consistently by using the ASA composition according to the invention.

EXAMPLE 4

Using three paper sizing compositions, sizing emulsions were prepared and the particle size thereof was determined immediately after the preparation and also 30 and 60 min thereafter. The Cobb 60 value of laboratory sheets which was achieved with a fresh emulsion and also with an emulsion aged for 60 min was furthermore determined.

The sizing agents employed are an ASA composition according to the invention (comprising ASA and a combination of Na-ASA (0.3%) with PEG 2000 (1%)) and AS 1000 (ASA without addition of emulsifier). The density of all the compositions before emulsification thereof with a starch-containing phase was 0.95 g/ml. Liquid starch of the Vector brand from Roquette with a concentration of 3.00 wt. % was employed as the starch. The emulsification was carried out via an aperture of 1.9 mm diameter under a pressure of 20 bar with a starch flow of 440.00 l/h and an ASA flow of 14.00 l/h. Amounts which in each case corresponded to 0.74 kg of ASA/t of paper were employed in the sizing experiments.

The particle size was measured by means of static light scattering with a Horiba LA-300 measuring apparatus. The volume distribution in water at a relative refractive index of 1.10 was determined. The value stated for the particle size in μm corresponds to that which was determined for 90% of the particles.

The results for the particle sizes and the Cobb 60 values are shown in the following table.

TABLE 4

| | ASA composition according to the invention | AS 1000 |
|---|---|---|
| Particle size (90%) after 0 min [μm] | 2.10 | 4.40 |
| Cobb 60 after 0 min [g/m$^2$] | 30 | 35 |
| Particle size (90%) after 60 min [μm] | 2.1 (30 min) | 4.50 |
| Cobb 60 after 60 min [g/m$^2$] | 31 | 38 |

The table shows that when liquid starch (Vector; Roquette) was used, it was possible to achieve both the smallest particles and the best sizing efficiency with the ASA composition according to the invention by emulsification at room temperature. This was also still the case after the emulsion had been stored for one hour.

EXAMPLE 5

Various sizing emulsions were prepared using an ASA composition according to the invention (comprising ASA and a combination of Na-ASA (0.3%) with PEG 2000 (1%)) and AS 1000 (an emulsifier-free ASA) and the particle size thereof was determined immediately after the preparation and also 20 min thereafter. The Cobb 60 value of laboratory sheets which was achieved with a fresh emulsion and also with an emulsion aged for 20 min was furthermore determined.

The ASA concentration of the compositions before emulsification thereof was 1.86%. An 80% strength potato starch (Cationamyl 9852) was employed as the starch in the aqueous phase in a concentration of 2.00%, based on ASA. The emulsification was carried out via an aperture of 1.9 mm diameter under a pressure of 20 bar and at a temperature of from 75 to 82° C. with a starch flow of 445.00 l/h and an ASA flow of 8.70 l/h. Amounts which in each case corresponded to 0.81 kg of ASA/t of paper were employed in the sizing experiments.

The results for the particle sizes and the Cobb 60 values are shown in the following table.

TABLE 5

| | ASA composition according to the invention | AS 1000 |
|---|---|---|
| Particle size (90%) after 0 min [μm] | 2.90 | 5.80 |
| Cobb 60 after 0 min [g/m$^2$] | 34 | 35 |
| Particle size (90%) after 60 min [μm] | 3.40 | 4.50 |
| Cobb 60 after 60 min [g/m$^2$] | 38 | 38 |

The table shows that when an 80% strength potato starch is used and with emulsification at elevated temperatures, good sizing values and particle sizes are achieved with the ASA composition according to the invention compared with the conventional sizing composition based on AS 1000. In contrast, the particle size of 5.8 μm shows that it was not possible to emulsify AS 1000 by this method.

EXAMPLE 6

Using three paper sizing compositions based on an ASA composition according to the invention (comprising ASA and a combination of Na-ASA (0.3%) with PEG 2000 (1%)), AS 2000 (an ASA with an anionic emulsifier) and AS 1000 (an emulsifier-free ASA), size emulsions were prepared by first emulsifying with pure water via an aperture of 1.9 mm diameter under a pressure of 20 bar, without using starch, a water flow of 440.00 l/h and an ASA flow of 9.00 l/h being used. The ASA concentration of the compositions before emulsification thereof was 1.94%. The emulsions obtained in this way were then stirred into a starch solution (Cationamyl 9852) at 37° C., so that a 0.1% strength size emulsion was obtained. These size emulsions were then employed for the sizing tests in amounts which in each case corresponded to 0.84 kg of ASA/t of paper.

TABLE 6

| | ASA composition according to the invention | AS 2000 | AS 1000 |
|---|---|---|---|
| Particle size (90%) in water [μm] | 4.80 | 4.00 | 7.80 |
| Particle size (90%) in starch [μm] | 4.90 | 5.70 | 9.10 |
| Cobb 60 [g/m$^2$] | 27 | 76 | 67 |
| Comments | | 2 phases | 2 phases |

As the table shows, an emulsion which was still stable was achieved for the sizing emulsion which contained the ASA sizing composition according to the invention, in spite of the large particle size, while phase separation already occurred when the sizing agents AS 2000 and AS 1000 were used. A satisfactory sizing action was furthermore achieved with the sizing emulsion containing the sizing composition according to the invention.

The invention claimed is:

1. A process for the preparation of a composition for sizing paper, the process comprising: generating an anionic emulsifier in situ by:

adding sodium hydroxide or potassium hydroxide to a sizing agent comprising alkenylsuccinic anhydride (ASA) having an alkenyl chain length of 12 to 24 carbon atoms, to form sodium or potassium salts of an alkenylsuccinic acid having an alkenyl chain length of 12 to 24 carbon atoms; and heating the sodium hydroxide or potassium hydroxide and the sizing agent at a temperature of 100 to 140° C.; and adding nonionic components of polyethylene glycols (PEG) having an average molecular weight of 200 to 8000 to the anionic emulsifier and dissolving the PEG therein by heating at a temperature of 100 to 140° C., to form the composition.

2. The process of claim 1, wherein the composition is emulsified with an aqueous phase under low shearing forces.

3. The process of claim 2, wherein the aqueous phase further comprises starch.

4. The process of claim 1, wherein the alkenylsuccinic acid has an alkenyl chain length of 16 to 18 carbon atoms.

5. The process of claim 1, wherein the anionic emulsifier and the nonionic components are present in an amount of up to 5 wt. %, based on the alkenylsuccinic anhydride.

6. The process of claim 1, wherein the anionic emulsifiers to nonionic components are at a weight ratio from 1:10 to 10:1.

7. A process for the preparation of a composition for sizing paper, the process comprising: generating an anionic emulsifier in situ by:

adding sodium hydroxide or potassium hydroxide to a sizing agent comprising alkenylsuccinic anhydride (ASA) having an alkenyl chain length of 17 to 24 carbon atoms, to form sodium or potassium salts of an alkenylsuccinic acid having an alkenyl chain length of 17 to 24 carbon atoms;

heating the sodium hydroxide or potassium hydroxide and the sizing agent at a temperature of 100 to 140° C.; and adding nonionic components of polyethylene glycols (PEG) having an average molecular weight of 200 to 8000 to the anionic emulsifier and dissolving the PEG therein by heating at a temperature of 100 to 140° C., to form the composition.

8. The process of claim 7, wherein the composition is emulsified with an aqueous phase under low shearing forces.

9. The process of claim 7, wherein the aqueous phase further comprises starch.

10. The process of claim 7, wherein the alkenylsuccinic acid has an alkenyl chain length of 17 to 18 carbon atoms.

11. The process of claim 7, wherein the anionic emulsifier and the nonionic components are present in an amount of up to 5 wt. %, based on the alkenylsuccinic anhydride.

12. The process of claim 7, wherein the anionic emulsifiers to nonionic components are at a weight ratio from 1:10 to 10:1.

13. The process of claim 1, wherein the alkenylsuccinic anhydride (ASA) has an alkenyl chain length of 16 to 18 carbon atoms.

14. The process of claim 1, wherein the nonionic components are polyethylene glycols (PEG) having an average molecular weight of 2000.

* * * * *